US008264346B2

(12) United States Patent
Petricoin et al.

(10) Patent No.: US 8,264,346 B2
(45) Date of Patent: Sep. 11, 2012

(54) METHOD AND APPARATUS FOR PROVIDING GRADUATED ANNUNCIATION OF AN IMPENDING ALARM IN A SECURITY SYSTEM

(75) Inventors: Dennis Petricoin, Hemlock, NY (US); Steven A Markham, Rochester, NY (US); Craig A Hayden, Rochester, NY (US); Dennis M Caler, Marion, NY (US)

(73) Assignee: Robert Bosch GmbH, Stuttgart (DE)

( * ) Notice: Subject to any disclaimer, the term of this patent is extended or adjusted under 35 U.S.C. 154(b) by 1689 days.

(21) Appl. No.: 11/103,175

(22) Filed: Apr. 11, 2005

(65) Prior Publication Data

US 2006/0227001 A1 Oct. 12, 2006

(51) Int. Cl.
*G08B 21/00* (2006.01)

(52) U.S. Cl. ..... 340/540; 340/815.4; 340/309.3

(58) Field of Classification Search ..... 340/540, 340/541, 517, 815.4, 531, 556, 309.4, 309.7, 340/309.3

See application file for complete search history.

(56) References Cited

U.S. PATENT DOCUMENTS

| | | | | |
|---|---|---|---|---|
| 4,808,972 A | | 2/1989 | Nicholls | 340/541 |
| 4,929,936 A | * | 5/1990 | Friedman et al. | 345/618 |
| 5,459,450 A | * | 10/1995 | Beghelli | 340/538 |
| 5,574,425 A | | 11/1996 | Shu | |
| 5,774,051 A | | 6/1998 | Kostusiak | |
| 5,877,676 A | * | 3/1999 | Shankarappa | 340/309.7 |
| 5,877,683 A | | 3/1999 | Sheasley | |
| 5,917,409 A | | 6/1999 | Wang | 340/506 |
| 6,127,936 A | * | 10/2000 | Gendel et al. | 340/692 |
| 6,157,299 A | | 12/2000 | Wang | 340/506 |
| 6,166,633 A | | 12/2000 | Wang | 340/506 |
| 6,204,760 B1 | * | 3/2001 | Brunius | 340/529 |
| 6,496,111 B1 | | 12/2002 | Hosack | 340/540 |
| 6,661,340 B1 | | 12/2003 | Saylor et al. | 340/517 |
| 6,943,685 B2 | * | 9/2005 | Seo | 340/541 |

FOREIGN PATENT DOCUMENTS

JP 2002 014721 A 1/2002

OTHER PUBLICATIONS

Honeywell, "Galaxy 16, 16 plus user's guide" [Online], 2003, XP002440981, retrieved from the Internet: URL: http://www.pr-alarms.co.uk/images/galaxy16userguide.pdf> [retrieved on Jul. 3, 2007], 11 pages.

Security House: "Galaxy 16 en 16 plus" Sales Brochure, Feb. 2001, XP002440982, the Netherlands, two pages.

Search Report for EP 06 00 6990 issued by the European Patent Office, The Hague, Jul. 18, 2007.

* cited by examiner

*Primary Examiner* — Anh V La
(74) *Attorney, Agent, or Firm* — Faegre Baker Daniels LLP

(57) ABSTRACT

A method of operating a security system includes sensing a security breach, and providing an indication to a user that an alarm signal will be issued in response to the sensing of the security breach. The indication perceptibly changes with time.

28 Claims, 4 Drawing Sheets

METHOD AND APPARATUS FOR PROVIDING GRADUATED ANNUNCIATION OF AN IMPENDING ALARM IN A SECURITY SYSTEM

BACKGROUND OF THE INVENTION

1. Field of the Invention

The present invention relates to surveillance systems that issue alarm signals, and, more particularly, to reducing the issuance of false alarm signals by such surveillance systems.

2. Description of the Related Art

Surveillance systems, also known as security systems, include security devices such as motion detectors for monitoring interior portions of a secured area of space, and door sensors and window sensors for monitoring perimeter portions of the secured area of space. When one of these sensors detects motion and/or the opening of a monitored door or window, the security system may issue an alarm signal that causes a siren to produce an audible alarm, and that is electronically communicated to a security company. The security company typically notifies the police, who may then visit the secured area of space in order to investigate.

A problem is that many of the alarm signals issued by a security system are what are known as "false alarms". False alarms are not the result of a genuinely dangerous condition, such as the presence of an intruder, but rather are a result of a resident of the building moving within the secured area of space and inadvertently causing an alarm signal to be issued. For example, a person returning home through their garage may enter through a side entry door of the garage that is monitored by the security system, or may open the side entry door to go outside after having driven into the garage through a garage door. Even if there is some time period provided by the security system to allow the resident to enter a passcode to thereby abort an alarm signal, the resident may not know, or may have forgotten, that the alarm system has been activated, and thus will not enter a passcode in time to prevent the occurrence of a false alarm. As another example, a resident may, without knowing or remembering that the alarm system has been activated, open a door in order to let a dog outside, or walk into a ground floor area that is monitored while the residents sleep on an upper floor. Again, even if the security system provides some audible or visual indication that a passcode needs to be provided in order to abort an alarm signal, the indication may not be of high enough intensity to get the attention of the resident, who may not be fully awake. The resulting audible alarm produced by a siren as a result of a false alarm often wakes many sleeping people needlessly. Moreover, investigations of the false alarms by the police are a waste of community resources and may result in the owners of the security system being monetarily fined.

An approach to reducing the false alarm problem is known as "entry delay", in which some time period is provided by the security system to allow the resident to enter a passcode to thereby abort an alarm signal, as mentioned above. Most security systems employ an entry delay period which begins when the initial entry door is violated. The user needs to disarm the system within a programmed time period in order to avoid a false alarm. That is, if the system is not disarmed within the given time period, an alarm response will begin.

Another approach is known as "dialer delay", which delays the sending of an alarm signal to a monitoring station for a predetermined time period. This gives the homeowner time to cancel the alarm before emergency service personnel are dispatched. The delay period begins when an alarm condition has been detected. The security system will delay the sending of an alarm signal to the central station for a programmed period of time. If the alarm condition is not acknowledged within the given time period, the security system will send a report to a central station.

A problem with both the entry delay and the dialer delay approach is that the resident of the secured building may not be aware that an alarm response is forthcoming, and that he needs to enter a passcode or take some other measure to prevent the alarm. A reason the resident may be unaware of the forthcoming alarm response is that he does not see or hear any indication from the security system that he needs to take action in order to avoid the alarm. Even if he does see and/or hear such an indication, the indication may not be of sufficient intensity to capture his attention and cause him to take action. Moreover, even if he does see and/or hear the indication, and it captures his attention, he may be too distracted, or may not be thinking clear enough, to comprehend the meaning or significance of the indication that he perceives.

A further problem is that even if the resident does see and/or hear an indication from the security system, the indication succeeds in capturing his attention, and he perceives its meaning, the indication does not inform the resident of how much time he has remaining to enter a passcode before it is too late to prevent an alarm response. Thus, it sometimes occurs that a resident overestimates an amount of time remaining to enter a passcode, and hence fails to enter the passcode within the allotted time, which results in a false alarm.

What is needed in the art is a security system, and method of operation therefor, that is capable of capturing a user's attention, regardless of where he is on the premises, and making the user aware that he needs to enter a passcode in order to prevent an alarm signal from being issued. What is also needed is a security system, and method of operation therefor, that provides a user with some indication of how much time is available for him to enter a passcode and thereby avoid the issuance of an alarm signal.

SUMMARY OF THE INVENTION

The present invention provides a security system that audibly and/or visually gives a user some indication of how much time is remaining for him to enter a passcode and thereby abort an alarm signal. The audible and/or visual indications increase in intensity with time in order to ensure that the attention of the user is captured, regardless of where he is on the premises. The security system provides audible, spoken word instructions for the user to enter a passcode, thereby ensuring that the user will comprehend the meaning of the indications regardless of his state of mind.

The invention comprises, in one form thereof, a method of operating a security system, including sensing a security breach, and providing an indication to a user that an alarm signal will be issued in response to the sensing of the security breach. The indication perceptibly changes with time.

The invention comprises, in another form thereof, a security system including a sensor for sensing a security breach and transmit a detection signal dependent thereon. An indicating device provides an indication to a user that an alarm signal will be issued in response to the detection signal. The indication perceptibly changes with time.

The invention comprises, in yet another form thereof, a method of operating a security system, including sensing a security breach, and providing an indication to a user that an alarm signal will be issued in response to the sensing of the security breach. The indication perceptibly changes with time to thereby indicate to the user a period of time elapsed since the sensing step and/or a period of time before the alarm signal will be issued.

An advantage of the present invention is that a user is provided with some indication of how much time is remaining before an alarm response will occur. Thus, the user can make sure that he enters his passcode in time to avoid a false alarm.

Another advantage is that the audible and/or visual indications provided by the security system increase in intensity with time to thereby ensure that the attention of the user is captured, regardless of where the user is on the premises.

Yet another advantage is that audible, spoken word instructions for the user to enter a passcode are provided, thereby ensuring that the user will comprehend the meaning of the indications and what course of action he should take, regardless of his state of mind.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
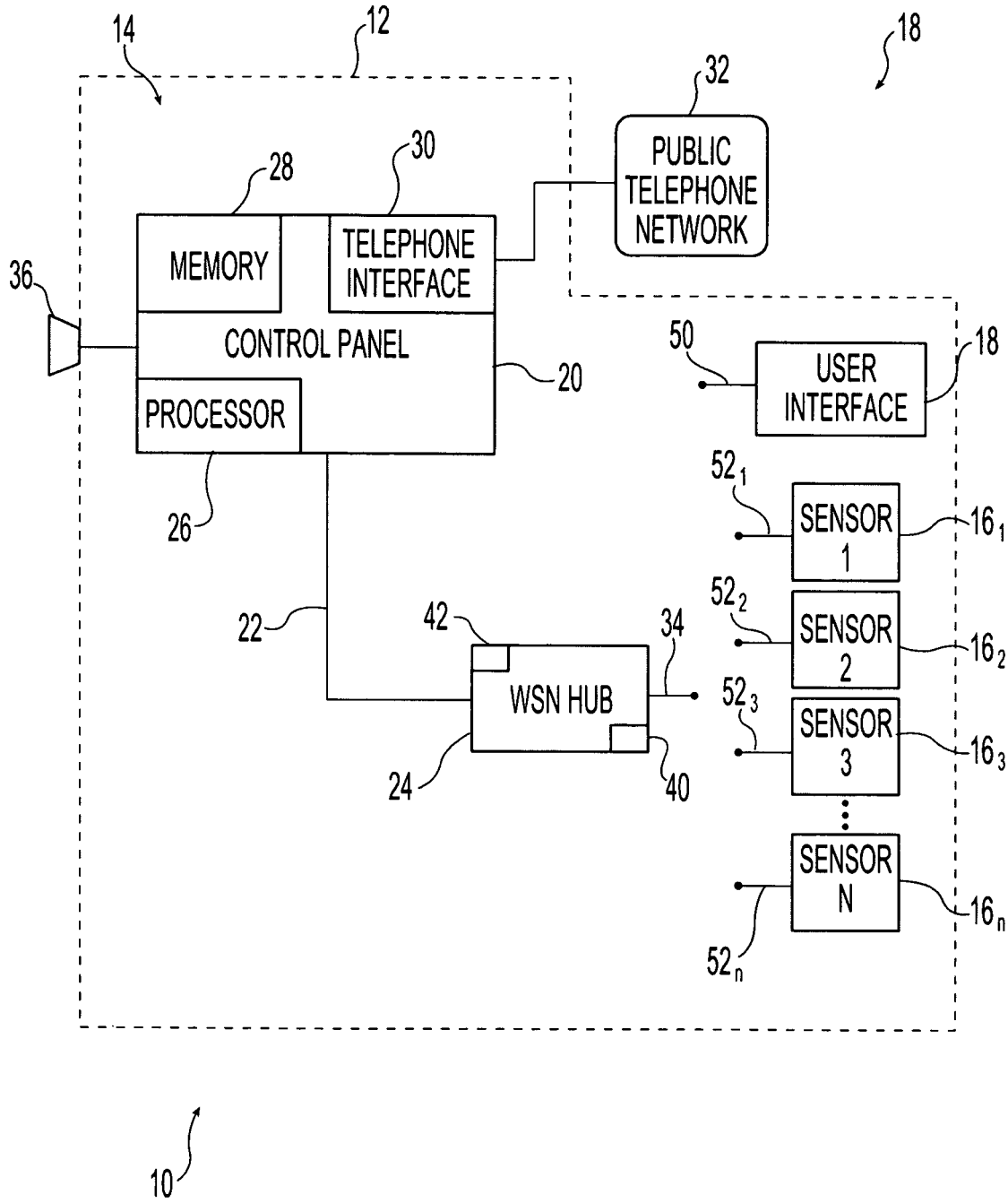
FIG. 1 is a block diagram of one embodiment of a security system of the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PRESENT INVENTION

Referring now to the drawings and particularly to FIG. 1, there is shown one embodiment of a security system 10 of the present invention for a structure 12 such as a building. However, system 10 may be used to secure other spaces, such as outdoor areas, subterranean rooms and passages, and zones of air space. System 10 includes a system controller 14, security sensors $\mathbf{16}_1$ through $\mathbf{16}_n$, and a user interface 18.

System controller 14 includes a control device in the form of a control panel 20 electrically connected via an option bus 22 to a wireless sensor network (WSN) hub 24. Control panel 20 may include a processor 26, a memory device 28 and a telephone interface 30. Processor 26 may coordinate communication with the various system components including WSN hub 24 and an audible alarm 36 associated with building 12. Memory 28 may include software for interpreting signals from sensor devices 16 and user interface 18, and deciding based thereon whether to initiate an alarm signal from control panel 20. The alarm signal may be used to activate audible alarm 36, or to notify a central station receiver (CSR) (not shown) such as a security company, fire station, or police station, for example, via public telephone network 32. After control panel 20 initiates an alarm signal, the alarm signal may be transmitted immediately to alarm 36 and/or to the CSR. Alternatively, after control panel 20 initiates an alarm signal, there may be a delay before the alarm signal is transmitted in order to provide the user time to abort the alarm signal transmission by entering a passcode in user interface 18 or by waving an identification token 38 (FIG. 2) near user interface 18. Memory 28 may also store identification information for sensors 16 such that control panel 20 may determine by analyzing a received signal which of sensors 16 transmitted the signal.

WSN hub 24 may include an antenna element 34 for transmitting and receiving air-borne signals, such as radio frequency signals. The radio frequency signals may be received by and transmitted from, i.e., exchanged with, sensors 16 and user interface 18. Information from sensors 16 and user interface 18 may be passed by WSN hub 24 to control panel 20 via option bus 22. Control panel 20 may pass information to WSN hub 24 via option bus 22 for transmission to sensors 16 and user interface 18 as necessary. WSN hub 24 may include a processor 40 and memory 42 for storing software and identification information associated with sensors 16 and user interface 18.

Sensors 16 may be in the form of any number or combination of perimeter sensors, such as window sensors and door sensors, and interior sensors, such as motion detectors. The window sensors may detect the opening and/or closing of a corresponding window (not shown) of building 12. The door sensors may detect the opening and/or closing of a corresponding door (not shown) of building 12. Door sensors are traditionally treated as "delay" sensors in that, after the door sensor detects that the corresponding door has been opened, there is a delay before the alarm signal is transmitted in order to provide the user time to abort the alarm signal transmission by entering a passcode in user interface 18 or by waving identification token 38 near user interface 18, as mentioned above. Conversely, window sensors are traditionally treated as "instant" sensors in that, after the window sensor detects that the corresponding window has been opened, the alarm signal is transmitted immediately. However, it is also possible within the scope of the present invention for window sensors to be treated as "delay" sensors. The motion sensors may each detect movement within a corresponding interior zone of the secured area, and are traditionally treated as "instant" sensors. However, again, it is possible for motion sensors to be treated as "delay" sensors.

Each sensor 16 may be wireless and may include a respective antenna element 52 for transmitting and receiving air-borne signals, such as radio frequency signals. The radio frequency signals may be received by and transmitted from, i.e., exchanged with, WSN hub 24. For example, each sensor 16 may send a detection signal to control panel 20 via hub 24 each time the sensor senses a security breach.

Figure 2:
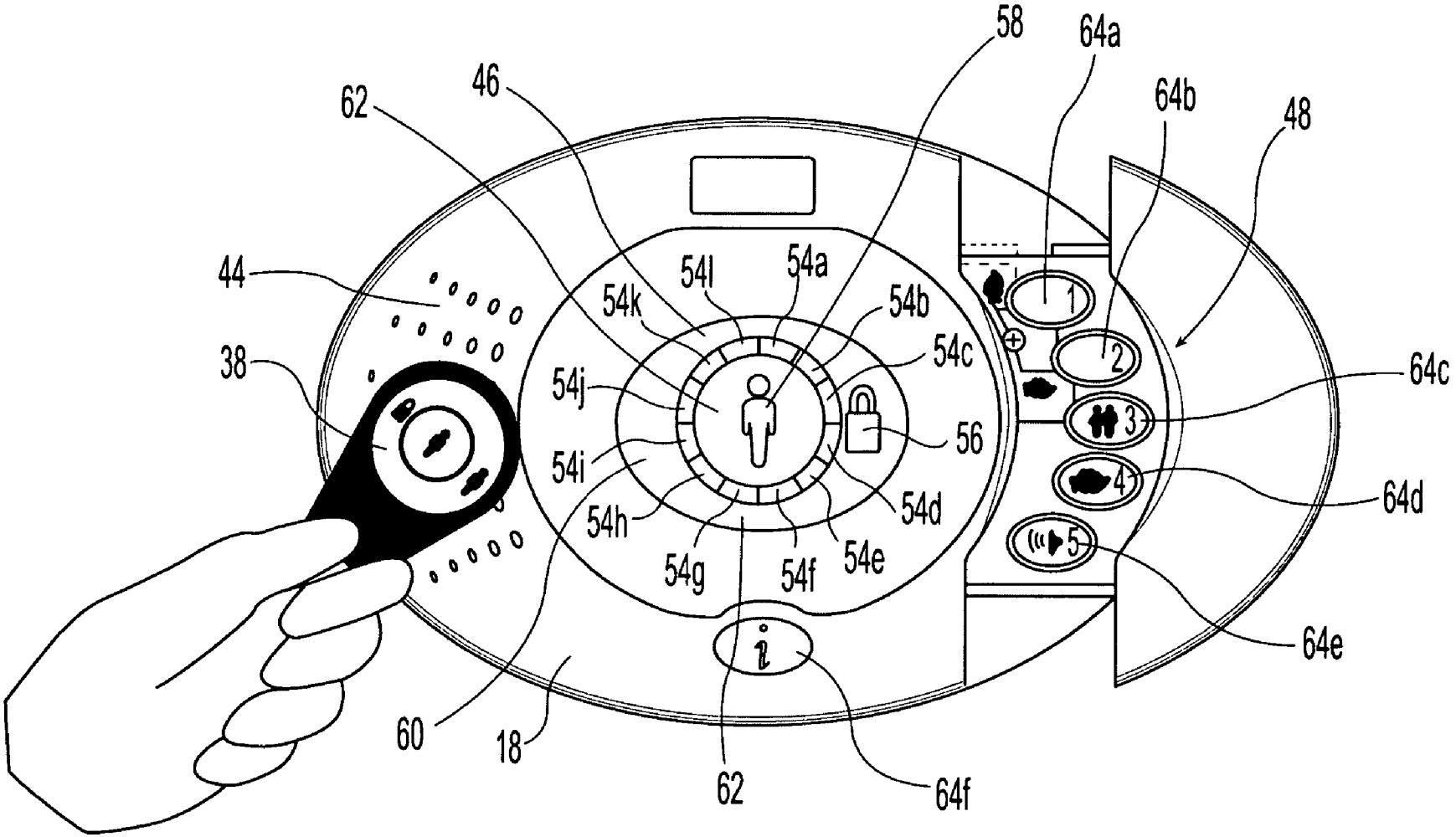
FIG. 2 is a plan view of one embodiment of the user interface of FIG. 1.

User interface 18 may be wireless and may include an antenna element 50 for exchanging air-borne signals with WSN hub 24. As shown in FIG. 2, user interface 18 may include a speaker 44, a visual display such as liquid crystal diode (LCD) display 46, and a keypad 48 or some other input that enables the user to select a mode of operation and otherwise program security system 10.

Speaker 44 may be capable of producing audible tones and audible spoken words that are intended to be heard by a user of security system 10. The content of the audio communications may be transmitted by control panel 20 to user interface 18 for broadcast by speaker 44.

Display 46 includes twelve segments 54*a-l* arranged in a circle, a lock icon 56, and a person icon 58. Each of segments 54 is individually selectively displayable. Lock icon 56 may be selectively displayable. More particularly, lock icon 56 may be displayed as shown when security system 10 is armed, and may not be displayed when security system 10 is not armed. Person icon 58 may be displayed as shown within the circle formed by segments 54 when system 10 is armed in the Stay mode; may be displayed outside the circle in area 60 when system 10 is armed in the Away mode; and may not be displayed at all when system 10 is not armed. Each of segments 54 and icons 56, 58 may be grey in color in contrast to a background 62 that has a selectable color. The color of background 62 may be selected to be either green, amber or red, for example, under the control of control panel 20.

Keypad 48 may include pushbuttons 64*a-f*. Pushbuttons 64*a-e* correspond to numbers 1-5, respectively, and may be depressed by the user to thereby enter a passcode having multiple digits. Pushbutton 64*e* may be used by the user, e.g., may be depressed multiple times, to set a volume level of the sounds produced by speaker 44. Pushbutton 64*f* may be depressed by the user in order to cause speaker 44 and/or display 46 to respectively produce audible and visible information and/or instructions for the benefit of the user.

Figure 3:
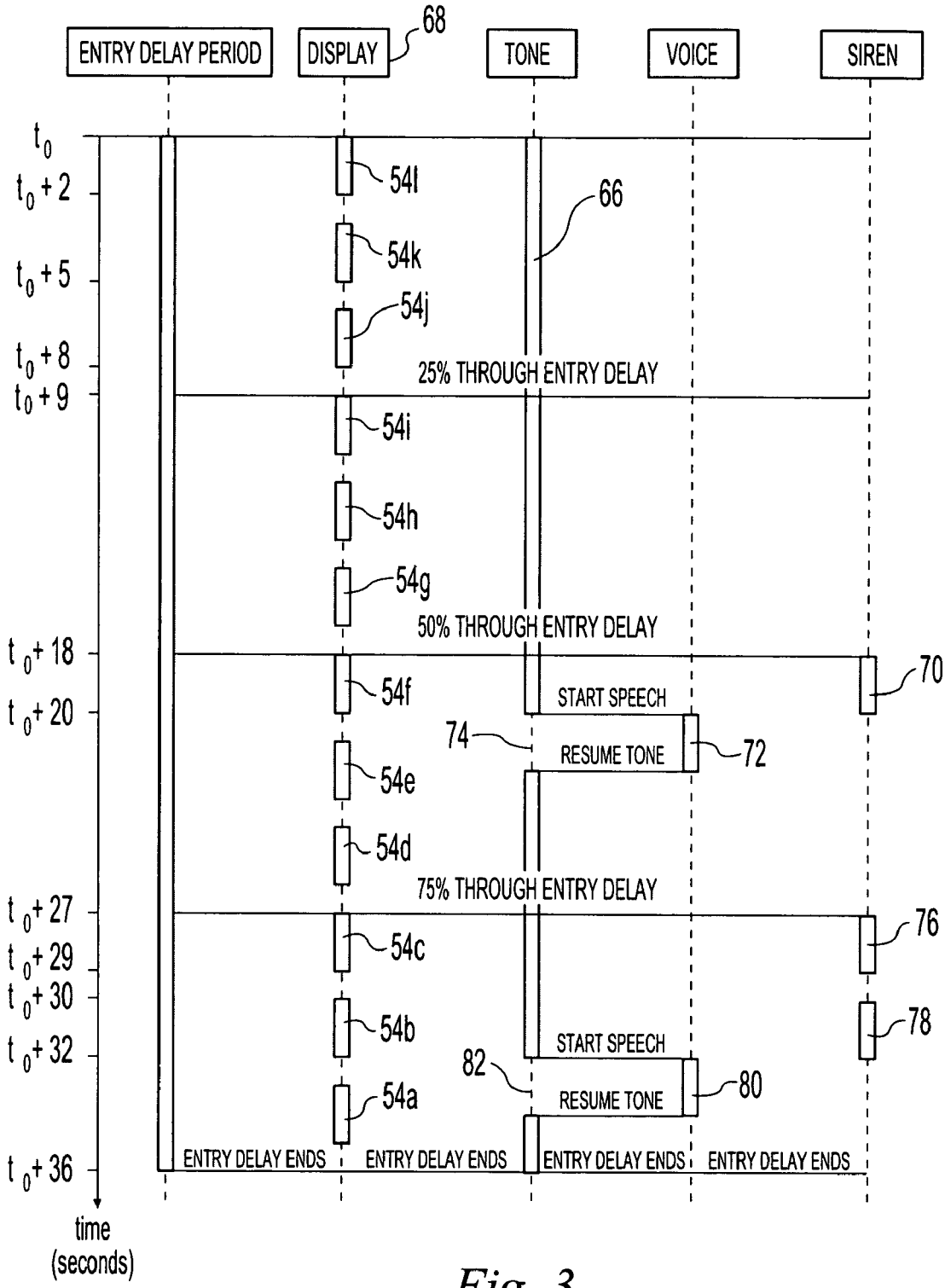
FIG. 3 is a timing diagram of one embodiment of a method of the present invention for operating the security system of FIG. 1.

One embodiment of a method of the present invention for operating security system 10 is illustrated in FIG. 3. FIG. 3 is a timing diagram of an entry delay period that begins at time $t_0$ when a security breach is sensed by sensors 16. The security breach may be, for example, the opening of a door of building 12 by an intruder or by a user of system 10, who may be a resident of building 12. In the illustrated embodiment, an alarm signal will be issued at time $t_0$+36 seconds unless a passcode is entered into keypad 48 or token 38 is placed near user display 18 sometime during the 36 second entry delay time period. The issuance of the alarm signal may cause audible alarm 36 to be activated and/or the CSR to be notified via telephone network 32. If the security breach was caused by a user of system 10 or a resident of building 12, then the issuance of the alarm signal would be considered a false alarm.

The duration of the entry delay period is arbitrarily illustrated as being 36 seconds. It is to be understood that the entry delay period may have any duration selected by the user and/or made available by the manufacturer of security system 10. The time duration of the entry delay period may typically be approximately between 20 seconds and 90 seconds.

During the entry delay period, indicating devices including siren 36, speaker 44 and display 46 generally provide indications to the user that an alarm signal will be issued in response to a detection signal from one or more of sensors 16. The indications may perceptibly change with time during the entry delay period. For example, the intensity of the indications may generally increase with time to thereby provide an indication to the user of how much time remains in which the user may abort the alarm signal, i.e., prevent the issuance of the alarm signal.

In the embodiment of FIG. 3, at time $t_0$ when the security breach is sensed by one or more of sensors 16, the backlighting of display 46 turns an amber color, i.e., the color of background 62 turns amber. Further, padlock icon 56 remains ON, i.e., is displayed; person icon 58 begins flashing ON and OFF with a frequency on the order of one cycle per second; and all twelve segments 54 are turned ON, i.e., are displayed. Also at time $t_0$, speaker 44 begins to broadcast an audible tone referenced with the number 66 in FIG. 3. In one embodiment, the tone has a frequency of 3000 Hz and repetitively cycles ON for 30 milliseconds and OFF for 300 milliseconds.

Under display heading 68 in FIG. 3, it is illustrated when each of segments 54*a-l* turns off during the entry delay period. Segments 54 may turn OFF sequentially in a counterclockwise direction starting at the top of the circle. For example, segment 54*l* turns OFF at time $t_0$+2 seconds, segment 54*k* turns OFF at time $t_0$+5 seconds, segment 54*j* turns OFF at time $t_0$+8 seconds, etc. The final segment 54*a* turns OFF at time $t_0$+35 seconds, approximately one second before the entry delay period ends and the alarm signal is issued. The sequential turning OFF of segments 54 provides a quantitative visual indication and a spatial representation of both a period of time elapsed since the security breach was sensed at time $t_0$, and a period of time remaining before the alarm signal will be issued at time $t_0$+36 seconds.

At time $t_0$+18 seconds, halfway through the entry delay period, the color of the backlighting, i.e., the color of background 62, changes from amber to red. Thus, the perceptible changing of the color of background 62 with time is another visual indication to the user that an alarm signal will be issued in response to the sensing of the security breach. The changing color of background 62 provides a qualitative visual indication of both a period of time elapsed since the security breach was sensed at time $t_0$, i.e., eighteen seconds, and a period of time remaining before the alarm signal will be issued at time $t_0$+36 seconds, i.e., also eighteen seconds.

Also at time $t_0$+18 seconds, an audio indication in the form of a single sound pulse 70 is produced for two seconds. For example, siren 36 may be activated for the two second time period between $t_0$+18 seconds and to +20 seconds. Thus, the sound pulse begins a period of time, i.e., eighteen seconds, after the security breach was sensed, and a period of time, i.e., eighteen seconds, before the alarm signal will be issued. Moreover, the sound pulse ends a period of time, i.e., twenty seconds, after the security breach was sensed, and a period of time, i.e., sixteen seconds, before the alarm signal will be issued.

Siren 36 may be loud enough to be easily heard by a user regardless of where he is located on the premises, either inside building 12 or outside building 12. Thus, even if the user is too far away from user interface 18 to see display 46 or to hear the tone from speaker 44, the sound pulse from siren 36 will capture his attention.

With the user's attention captured, user interface 18 then, as referenced with number 72 in FIG. 3 at time $t_0$+20 seconds, audibly provides spoken word information to the user to explain the significance of the audible siren pulse and/or the visual indication of display 46. The spoken word information may also direct the user as to what action he should take. This spoken word information may be helpful in avoiding false alarms in situations in which the user is confused, only vaguely familiar with the security system, or in a state of mind that does not enable him to comprehend that he must enter his passcode or place his token 38 near user interface 18. For example, a spoken word announcement from speaker 44 may state, "To turn off your system, present your token or enter your passcode". As referenced at 74 in FIG. 3, the audio tone 66 may be suspended during announcement 72.

At time $t_0$+27 seconds, three-quarters through the entry delay period, another audio indication in the form of a pair of sound pulses are produced. A first pulse 76 has a two second duration, ending at time $t_0$+29 seconds. After a one second respite, a second pulse 78 also has a two second duration, beginning at time $t_0$+30 seconds and $t_0$+32 seconds. As with sound pulse 70, pulses 76, 78 may each be in the form of an activation of siren 36. The double pulse activation of siren 36 may be, even to a greater degree than single pulse 70, loud enough and long enough to be easily heard by a user regardless of where he is located on the premises, either inside building 12 or outside building 12.

User interface 18 then, as referenced with number 80 in FIG. 3 at time $t_0$+32 seconds, audibly provides another spoken word announcement similar or identical to announcement 72. As referenced at 82 in FIG. 3, the audio tone 66 may again be suspended during announcement 80.

Finally, if the user has not entered his passcode or presented a token 38 by time $t_0$+36 seconds, then an alarm signal is issued. That is, siren 36 may be activated for a longer period, such as several minutes or more, and a CSR may be notified via telephone network 32.

The time duration of each of announcements 72, 80 is shown as two seconds in FIG. 3. However, it is to be understood that the lengths of announcements 72, 80 may be three or more seconds. Moreover, the starting times of announcements 72, 80, as well as the starting times and durations of sound pulses 70, 76, 78, may be other than as shown in FIG. 3 within the scope of the invention.

Figure 4:
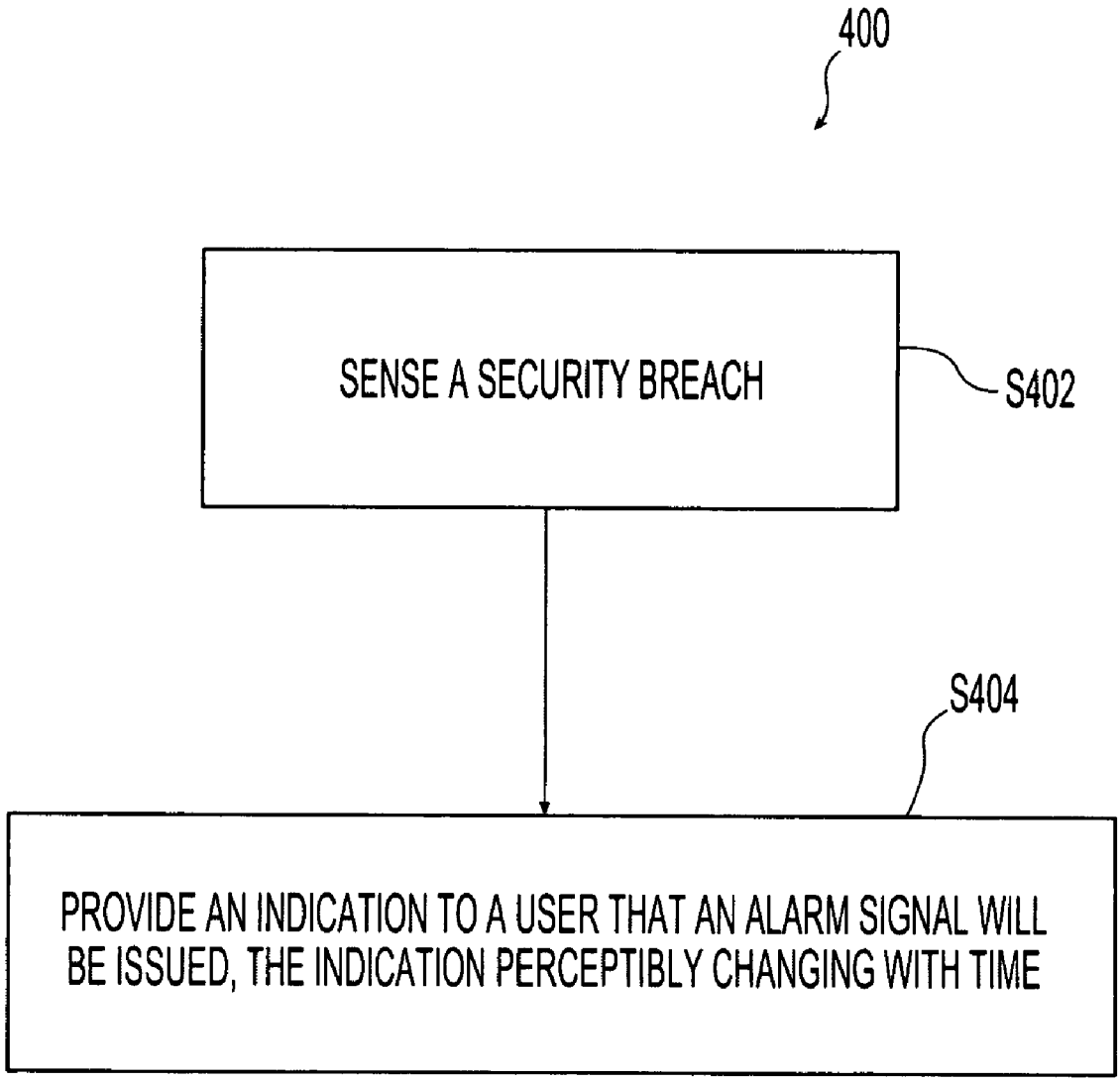
FIG. 4 is a flow chart of another embodiment of a method of the present invention for operating the security system of FIG. 1.

Another embodiment of a method 400 of the present invention for operating security system 10 is illustrated in FIG. 4. In a first step S402, a security breach is sensed. For example, one of sensors 16 may detect the opening of a door or window of building 12. As another example, one or more of sensors 16 may detect movement within building 12. The sensor sensing the security breach may transmit to control panel 20 a detection signal that is dependent upon the sensed security breach.

In a second step S404, an indication is provided to a user that an alarm signal will be issued, the indication perceptibly changing with time. The embodiment discussed above with reference to FIG. 3 discloses several types of indications, including both visual indications and audio indications, that an alarm signal will be issued. These indications perceptibly change with time. As an example of a visual indication, the backlighting color of background 62 may change to amber when a security breach is sensed, and then may change to red halfway through the entry delay time period. The sequential turning OFF or extinguishing of the twelve segments 54 over the course of the entry delay time period is another alarm signal issuance indication that visually and perceptibly changes with time.

An example of an audio indication of an impeding alarm signal is the spoken word announcement from speaker 44. The spoken word announcement changes with time in that it is silent or nonexistent during the first half of the entry delay time period, and is broadcast only in the third and fourth quarters of the entry delay time period. Another example of an audio indication of the impeding alarm signal that perceptibly changes with time is entry delay tone pattern 66. Tone pattern 66 is broadcast consistently throughout the entry delay time period with the exception that it ceases or is suspended during announcements 72, 80 in the third and fourth quarters, respectively, of the entry delay time period. A third example of an audio indication of the impeding alarm signal that perceptibly changes with time is the activation of audible alarm 36. This siren sound pulse changes with time in that it is silent or nonexistent during the first half of the entry delay time period, and is broadcast only in the third and fourth quarters of the entry delay time period. Another aspect of the changes of the siren broadcast is that only one sound pulse is provided in the third quarter of the entry delay time period, and two pulses are provided in the fourth quarter.

The audio and visual indications of the present invention have been described herein as being indicative of both an amount of time elapsed since the security breach and an amount of time remaining before an alarm signal will be issued. However, it is also possible within the scope of the invention for the entry delay period to have a time duration that is not predetermined. That is, the entry delay period may have a time duration that is dependent upon one or more events that occur after the security breach. Thus, the audio and visual indications may possibly be indicative of only an amount of time elapsed since the security breach, or only an amount of time remaining before an alarm signal will be issued, but not indicative of both amounts of time.

While this invention has been described as having an exemplary design, the present invention may be further modified within the spirit and scope of this disclosure. This application is therefore intended to cover any variations, uses, or adaptations of the invention using its general principles.

What is claimed is:

1. A method of operating a security system, said method comprising the steps of:

sensing a security breach; and providing an indication to a user that an alarm signal will be issued in response to said sensing step, the indication perceptibly changing with time.

2. The method of claim 1 wherein the indication comprises a visual indication.

3. The method of claim 2 wherein the visual indication comprises a spatial representation of at least one of:

a period of time elapsed since said sensing step; and a period of time before the alarm signal will be issued.

4. The method of claim 2 wherein the changing of the indication comprises a changing of a color of the visual indication.

5. The method of claim 1 wherein the indication comprises an audio indication.

6. The method of claim 5 wherein the audio indication includes spoken words beginning at least one of:

a period of time after said sensing step; and a period of time before the alarm signal will be issued.

7. The method of claim 5 wherein the audio indication includes a sound pulse beginning at least one of:

a period of time after said sensing step; and a period of time before the alarm signal will be issued.

8. The method of claim 1 further comprising activating an alarm in response to the sensing step unless the user aborts the activating step within a predetermined period of time after the sensing step occurs.

9. The method of claim 8 wherein the indication is provided to the user during the predetermined period of time to alert the user of the need to abort the alarm activating step.

10. A security system comprising:

a sensor configured to sense a security breach and transmit a detection signal dependent thereon; and an indicating device configured to provide an indication to a user that an alarm signal will be issued in response to the detection signal, the indication perceptibly changing with time.

11. The security system of claim 10 wherein the indication comprises a visual indication.

12. The security system of claim 11 wherein the visual indication comprises a spatial representation of at least one of:

a period of time elapsed since the sensing of the security breach; and a period of time before the alarm signal will be issued.

13. The security system of claim 11 wherein the changing of the indication comprises a changing of a color of the visual indication.

14. The security system of claim 10 wherein the indication comprises an audio indication.

15. The security system of claim 14 wherein the audio indication includes spoken words beginning at least one of:

a period of time after the sensing of the security breach; and a period of time before the alarm signal will be issued.

16. The security system of claim 14 wherein the audio indication includes a sound pulse beginning at least one of:

a period of time after the sensing of the security breach; and a period of time before the alarm signal will be issued.

17. The system of claim 10 further comprising:

a controller configured to receive the detection signal from the sensor, the controller being configured to issue the alarm signal after a predetermined time delay period from receipt of the detection signal; and a user interface to permit the user to abort the alarm signal within the predetermined time delay period.

18. The system of claim 17 further comprising a wireless sensor network hub to provide communication between the controller and sensor.

19. The system of claim 17 wherein the controller includes a telephone interface to send the alarm signal to a central station receiver.

20. The system of claim 17 wherein the indicating device provides the indication to the user during the predetermined time delay period to alert the user of the need to abort the issuance of the alarm signal.

21. The system of claim 17 wherein the user interface is configured to receive at least one of a passcode entered by the user and an input from an identification token located near the interface to abort the alarm signal within the predetermined time delay period.

22. A method of operating a security system, said method comprising the steps of:

sensing a security breach; and providing an indication to a user that an alarm signal will be issued in response to said sensing step, the indication perceptibly changing with time to thereby indicate to the user at least one of:

a period of time elapsed since said sensing step; and a period of time before the alarm signal will be issued.

23. The method of claim 22 wherein the indication comprises a visual indication.

24. The method of claim 23 wherein the visual indication comprises a spatial representation of at least one of:

a period of time elapsed since said sensing step; and a period of time before the alarm signal will be issued.

25. The method of claim 23 wherein the changing of the indication comprises a changing of a color of the visual indication.

26. The method of claim 22 wherein the indication comprises an audio indication.

27. The method of claim 26 wherein the audio indication includes spoken words beginning at least one of:

a period of time after said sensing step; and a period of time before the alarm signal will be issued.

28. The method of claim 26 wherein the audio indication includes a sound pulse beginning at least one of:

a period of time after said sensing step; and a period of time before the alarm signal will be issued.

* * * * *